United States Patent [19]

Boyd

[11] 4,098,233

[45] Jul. 4, 1978

[54] TIMING GAUGE FOR DIESEL ENGINES

[75] Inventor: Darrell B. Boyd, 2500 E. James C-16, Baytown, Tex. 77520

[73] Assignees: Darrell B. Boyd; Kathy Sue Boyd; Mark A. Stodola; James E. Hall; Stuart C. Vess, all of Little Rock; J. Russell Reinmiller, North Little Rock, all of Ark. ; part interest to each

[21] Appl. No.: 792,649

[22] Filed: May 2, 1977

[51] Int. Cl.[2] ..... F02M 65/00

[52] U.S. Cl. ..... 123/32 R; 73/119 A; 81/3 R; 239/88

[58] Field of Search ..... 123/1 R, 32 R, 139 AK, 123/27 R; 81/3 R, 3 F; 116/124 D; 73/119 A; 239/88

[56] References Cited

U.S. PATENT DOCUMENTS

| | | | |
|---|---|---|---|
| 2,285,730 | 6/1942 | Lindeman, Jr. | 123/139 AK X |
| 2,642,047 | 6/1953 | Johnson | 123/32 R X |
| 3,026,723 | 3/1962 | Cief | 7 3/119 A |

OTHER PUBLICATIONS

*Diesel Engineering Handbook,* Copyright 1963, Diesel Publications, Inc., Stamford, Conn., p. 105.

*Primary Examiner*—Charles J. Myhre
*Assistant Examiner*—Tony M. Argenbright
*Attorney, Agent, or Firm*—John A. Hamilton

[57] ABSTRACT

A gauge for use in connection with the timing of a diesel engine and adapted to measure the spacing between an injector body surface and a surface of the plunger of the injector, the surfaces being parallel, the gauge consisting of a gauge body restable on the plunger surface and a gauge stem restable on the body surface and extending slidably through the gauge body parallel to the direction of plunger movement, the stem having a planar surface normal to its axis which will be moved into coplanar relation to a corresponding planar surface of the gauge body when the spacing being measured is correctly adjusted, the coplanar relation of these surfaces, or any lack thereof, being readily detectable by touch when passing a fingertip thereover.

7 Claims, 3 Drawing Figures

TIMING GAUGE FOR DIESEL ENGINES

Figure 1:
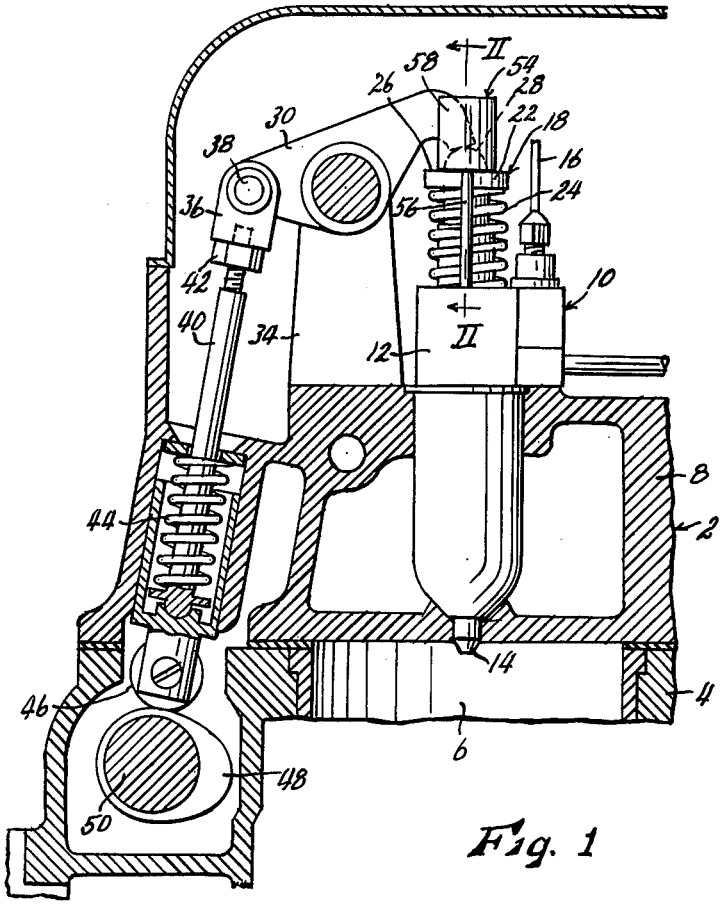

This invention relates to new and useful improvements in timing gauges for diesel engines, and has as its principal object the provision of a gauge, the operation of which is not subject to the human error often occurring with gauges in present use.

In diesel engines, each cylinder is provided with a fuel injector mounted in the engine head and having a plunger projecting above said head to inject a charge of fuel into the cylinder each time said plunger is depressed. Obviously, the fuel must be injected at the proper point in the stroke of the piston movable in the cylinder. For this purpose, the plunger is alternately depressed and released by an operating mechanism including a camshaft driven by the crankshaft of the engine, which of course controls the position of the pistons in the cylinders. However, due to manufacturing variations and other causes, such as wear of parts, the accuracy of the operating mechanism is not sufficient, or will not remain sufficient, to time the fuel injection with sufficient precision to insure efficient operation of the engine. Therefore, it is customary to provide a means for adjusting the operating mechanism of the injector of each cylinder, independently of all other cylinders, to adjust the timing of the fuel injection with respect to that cylinder. Some means must be provided for gauging this adjustment, and an improved gauge for this purpose is the overall object of the present invention.

Each injector is operable to inject a charge of fuel responsively to the stroke of a plunger carried therein, said plunger projecting outwardly from the head block of the engine and being moved in its injection stroke by a cam, push rod and rocker arm constituting its operating mechanism. The injection is considered to be properly timed when the maximum outward projection of the plunger from a specified surface of the body of the injector is at a specified figure. This "timer spacing" is a standard, specified figure for each injector, most commonly either 1.460 inches or 1.484 inches. It must be quite accurately adjusted for maximum engine efficiency. The gauge presently in use for this purpose consists of a stem reduced at its lower end to be inserted in a socket provided therefor in the injector body to project upwardly therefrom parallel to and adjacent the plunger, and having a right-angled arm affixed thereto at the reguired "timer spacing" from its lower end. The operating mechanism is then adjusted, which either depresses or raises the plunger, until the gauge arm, when the stem is turned in its socket, "wipes lightly" over the outer end surface of the plunger. Difficulties arising from the use of this type of gauge are largely matters of human error. The stem must be pressed firmly into its socket to prevent it from rising when the arm wipes over the follower. This pressure must be manual, and the physical tension caused thereby interferes with the operator's sensitivity in "feeling" the force reguired to "wipe" the gauge arm over the plunger. Also, the sense of "feel" of various operators may vary widely as to what "wipe lightly" may mean. If his "touch" is too delicate, he may feel grating between the gauge arm and mere bits or grit or the like on the plunger surface, interpret this as "light wiping", and thus adjust the plunger to a position in which it is too far depressed. If his touch is too insensitive, he may wipe the arm across the plunger with so much pressure therebetween that the gauge stem is actually raised slightly from its socket with the result that the plunger is adjusted to a position in which it is too far extended. The errors may not be large, but the accuracy required is measured in thousandths of an inch, so any error is important.

The present gauge solves these difficulties by providing a gauge consisting of a stem engageable in a socket of the injector body, as before, and a gauge body freely slidable on said stem. The upper and lower surfaces of the gauge body are accurately at right angles to the stem, the lower surface being restable on the upper surface of the plunger, and the parts being so dimensioned that when adjustment of the operating mechanism has provided the correct timer spacing, the top surface of an enlarged head of the stem will be accurately coplanar with the top surface of the gauge body. The coplanar relation, or any lack of it, may be detected by passing a fingertip thereover.

Other objects are the provision of a gauge of the character described which is extremely simple and economical in manufacture, and easy, convenient and dependable in use.

Figure 2:
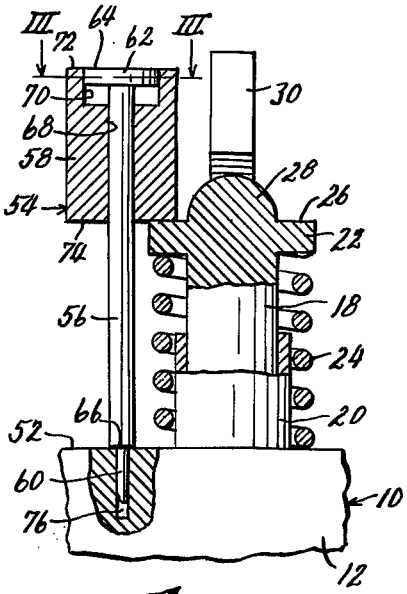
Figure 3:
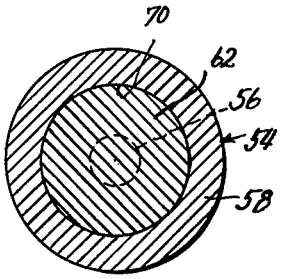

With these objects in view, as well as other objects which will appear in the course of the specification, reference will be had to the accompanying drawing, wherein:

FIG. 1 is a fragmentary cross-sectional view of a diesel engine, with parts omitted, showing a timing gauge embodying the present invention operatively applied thereto, FIG. 2 is an enlarged, fragmentary sectional view taken on line II—II of FIG. 1, with parts left in elevation and partially broken away, and FIG. 3 is an enlarged sectional view taken on line III—III of FIG. 2.

Like reference numerals apply to similar parts throughout the several veiws, and the numeral 2 applies generally to a diesel engine including a cylinder block 4 having a series of cylinders 6 (one shown) formed therein, and a head block 8. For each cylinder, there is provided an injector designated generally by the numeral 10, said injector including a body 12 secured to head block 8 by any suitable means, not shown, and an injector tube projecting through head 8 and terminating in an injector nozzle 14 operable to inject atomized fuel into the cylinder. Said injector receives fuel oil from any suitable source through a conduit 16. It will be understood, as well known in the art, that the injector includes internal mechanism operable each time it is actuated to inject a charge of fuel through nozzle 14. Said mechanism is operated by a plunger 18 vertically movable in a plunger guide 20 of the injector body, and provided at its upper projecting end with an enlarged head 22 biased upwardly by a spring 24 based on injector body 12. The upper surface 26 of head 22, or at least the peripheral portion thereof, is planar and accurately at right angles to the direction of plunger movement. It may be provided centrally with a spherically curved boss 28 for cooperating with the rocker arm, as will appear.

Each injector is operated by a rocker arm 30 pivotally mounted intermediate its ends on a rocker shaft 32 carried above the engine head by suitable supports 34 based on head block 8, and extending parallel to the line of cylinders. One end of said rocker arm bears downwardly on head 22 of the plunger, or on boss 28 thereof, and the other end of the rocker arm has a clevis 36 pivoted thereto at 38, the pivotal axis being parallel to the rocker shaft. A push rod 40 is threaded into said clevis, extending radially downwardly from pivot 38, the effective length of said push rod being adjustable by turning it to screw it more or less deeply into clevis 36, and the adjustment is fixable by a lock nut 42. The push rod 40 forms an element of a push rod assembly biased downwardly by a spring 44 to pivot rocker arm 30 in a counter-clockwise direction, as viewed in FIG. 1, and carrying a follower roller 46 rotatably at its lower end which engages a cam lobe 48 fixed on a cam shaft 50 rotatably mounted in the cylinder block. Although not shown, as well known in the art each cylinder 6 has a piston operably reciprocable therein to turn a crankshaft, and cam shaft 50 is turned by means of a suitable drive train from said crankshaft, at a proper speed ratio (one to one in a two-cycle engine). Thus, when the timing is correct, cam 48 will act through push rod 40 to pivot rocker arm 30 to depress plunger 18 to inject a charge of fuel into the cylinder at the proper instant with relation to the position of the piston in that cylinder. The structure thus far described is common and well known in the art.

Proper timing requires that when plunger 18 is fully elevated as far as permitted by the rocker arm (i.e. follower roller 46 is not elevated by cam lobe 48) plunger 18 be elevated to a specific and specified distance with relation to the injector body 12, this "timer spacing" being a built-in design characteristic for each type of injector, and being imprinted on the injector itself or otherwise readily available to the user. The timer spacing may of course be adjusted by loosening and backing off lock nut 42, then turning push rod 40 to change its effective length, thereby pivoting rocker arm 30 to raise or lower plunger 18.

The present gauge measures the distance parallel to the direction of plunger movement, between two selected points, one on the injector body itself and one on the plunger. The most convenient reference points to use are the planar top surface 26 of head 22 of the plunger, and the top surface 52 of the body 12 of the injector. Both of these surfaces are normally at right angles to the direction of plunger movement, and are the reference points commonly used by the manufacturer in specifying the proper "timer spacing."

The gauge contemplated by the present invention is designated generally by the numeral 54, and includes a stem 56 and a body member 58. Stem 56 comprises a straight, cylindrical rod with one end portion thereof reduced in diameter to form a spindle 60, the free end of which is rounded. The stem is provided at its opposite end with an enlarged cylindrical head 62 concentric therewith and rigidly affixed thereto. The exposed outer surface 64 of said head is planar and is formed accurately at right angles to the stem axis. The stem is used with its spindle 60 at its lower end, and a downwardly facing shoulder 66 is formed at the juncture of the stem and spindle. Gauge body 58 is cylindrical in form, and has a bore 68 formed axially through a major portion of the length thereof which is engaged snugly but slidably on stem 56, so as to be freely movable along said stem. The upper end of bore 68 is coaxially counterbored to form a cylindrical socket 70 in which head 62 of the stem is disposed for axial sliding movement. The upper surface 72 of the body member, and also its lower end surface 74, are formed accurately at right angles to the axis of its bore. The axial length of the body member may be as desired, so long as bore 68 is of sufficient length to prevent any appreciable tilting of the head on the stem, but the axial length of the stem, from shoulder 66 to the upper surface 64 of stem head 62, must be accurately equal to the prescribed "timer spacing" between surfaces 26 and 52, plus the axial length of the gauge body. The depth of socket 70 of the body member is substantially greater than the thickness of stem head 62. The surfaces of stem 56, bore 68, socket 70, and also top and bottom surfaces 72 and 74 of the body member, should be very accurately machined, and preferably polished. The fit of stem 56 in bore 68, and of stem head 62 in socket 70, whould be as close as possible while still maintaining a "zero-drag" fit.

In the use of the gauge, cam shaft 50 is first turned to a position in which follower roller 46 of push rod 40 is not engaged by an elevated portion of cam lobe 48, so that plunger 18 of the injector is disposed at the highest position permitted by rocker arm 30. Then spindle 60 of the gauge stem is inserted downwardly into a closely fitting socket 76 provided therefor in the top surface 52 of injector body 12, until shoulder 66 of the stem rests on said surface. Surface 52 should be thoroughly cleaned before insertion of the stem spindle, to insure that there will be no accumulation of grease and grime thereon which might elevate the shoulder 66 out of full engagement with said surface, and thus reduce the accuracy of the gauge. Also, socket 76 should have a depth greater than the length of spindle 60, to insure that no accumulation of grease in the socket could limit the insertion of the spindle. A socket 76 is normally provided in each injector by the manufacturer, for use with gauges already in use, but sockets could be specially formed if necessary. The socket is disposed adjacent the plunger of the injector, and is parallel thereto, so that when gauge spindle 60 is inserted as described, stem 56 projects upwardly parallel to said plunger, past the edge of head 22 of said plunger.

The lower surface 74 of gauge body 58 is then rested on top surface 26 of head 22 of plunger 18, as best shown in FIG. 2. Surface 26 should also be thoroughly cleaned of all grease and grime so that the gauge body rests accurately thereon. At this time, top surface 64 of stem head 62 will be precisely flush with the top surface 72 of the gauge body if the timing adjustment of the injector is correct, since the length of the stem (from shoulder 66 to surface 64) is precisely equal to the prescribed timer spacing (between surfaces 26 and 52) plus the axial length of the body member. The operator wipes a fingertip over surfaces 64 and 72, and can thereby readily detect any variation of the planes thereof. If any such variation is detected, the operator loosens lock nut 42 of the corresponding push rod 40 and turns the push rod to screw it farther into or out of clevis 36, thus varying the effective length of the push rod and causing rocker arm 30 to raise or lower plunger 18 until a precisely coplanar relation between surfaces 64 and 72 is obtained, whereupon lock nut 42 is re-tightened. The process is of course repeated for each cylinder of the engine.

Thus it will be apparent that a timing gauge having several advantages over those presently in use, as previously described, has been produced. All manual pressure exerted during its use is in a downward direction against surfaces 64 and 72, and thus presses both body 58 firmly against surface 26, and stem shoulder 66 against injector body surface 52. Thus there can be no tendency in the use of the gauge to lift either gauge element from its mating injector element, which as previously described was a common source of error with previous gauges. The downward finger pressure on the gauge elements is also equalized by the fact that a single finger exerts pressure on both gauge elements. Use of the present gauge, in the final detecting step, involves no relative movement of the gauge elements relatively to the injector elements supporting them, such as "wiping" an arm fixed to the gauge stem over the top surface of the plunger of the injector as with prior gauges. Such relative motions, due to variation in the sensitivity of the sense of "feel" of different operators, has also been a source of error in the use of prior gauges. Also, the human fingertip is a remarkably sensitive instrument for detecting any lack of coplanar relation between gauge surfaces 64 and 72. As long as these surfaces are smoothly polished as described, and stem head 62 fits snugly in body socket 70 so that there is no radial gap therebetween detectable to the touch, a person's fingertip may detect a displacement of these surfaces from coplanar relation of as little as one-thousandth of an inch. The detection is of course made by feeling a "ridge" formed along the juncture line of the two surfaces when they are not coplanar, and the sensitivity of the gauge is therefore increased if the stem head and body member edges defining this juncture line are formed to be as clearly sharp and unblunted as possible, since this renders any such "ridge" more easily detectable by the fingertip.

While I have shown and described a specific embodiment of my invention, it will be readily apparent that many minor changes of structure and operation could be made without departing from the spirit of the invention.

What I claim as new and desire to protect by Letters Patent is:

1. A timing gauge for an injector of a diesel engine, said injector including a body having an outwardly facing external surface and an operating plunger projecting outwardly from said body and being movable normally to said body surface in the operation of said injector, the projecting portion of said plunger having an outwardly facing surface parallel to said body surface, the correct timing of said injector being indicated when the spacing between said body and plunger surfaces equals a specified distance, denoted the "timer spacing" of said injector, when the piston operable in the engine cylinder associated with that injector is disposed at a specified point in its stroke, said gauge being usuable when said piston is at said specified point in its stroke, and comprising:

a. a stem restable at one end on said body surface to extend outwardly therefrom parallel to and adjacent said plunger, and having an outer end surface at right angles to the axis thereof, and b. a gauge body provided with an axial bore slidably mounted on said stem for movement therealong and having end surfaces at right angles to said stem, the inner end surface of said body being restable on said plunger surface, and the projection of said stem from said injector body surface being equal to the sum of said specified timer spacing and the axial length of said gauge body, whereby when the timer spacing of said injector is properly set, the outer end surfaces of said gauge stem and body will be disposed accurately in coplanar relation, the existence of this coplanar relation, or any lack of it, being detected by passing a fingertip over said outer end surfaces of said gauge members.

2. A timing gauge as recited in claim 1 wherein the outer end surfaces of said gauge stem and body are smoothly polished, whereby to assist in the fingertip detection of any deviation thereof from coplanar relation.

3. A timing gauge as recited in claim 1 wherein said gauge stem is provided at its outer end with an enlarged head slidably movable in an enlargement of the stem bore of said gauge body, the projection of said stem being measured to the outer surface of said head.

4. A timing gauge as recited in claim 3 wherein said gauge stem and body are fitted together as finely and accurately as possible while still maintaining a freely slidable "no-drag" relation of said stem in the bore of said gauge body and of said stem head in the enlargement of said bore, whereby to limit any relative movement of these elements to axial sliding movement.

5. A timing gauge as recited in claim 1 wherein said stem is provided at the end thereof restable on said injector body with an axially projecting reduced spindle insertable into a socket provided therefor in said injector body, the axis of said socket being parallel to the direction of operating movement of said injector plunger, whereby said gauge stem is maintained parallel to said direction of plunger movement.

6. A timing gauge as recited in claim 5 wherein the reduction of said stem to produce said spindle provides a shoulder at right angles to said stem, said shoulder being restable on said injector body surface, whereby the projection of said stem from said injector surface equals the length of said stem from said shoulder to the outer end thereof.

7. A timing gauge as recited in claim 6 wherein the depth of said injector body socket is greater than the axial length of the spindle of said stem, whereby to preclude any possibility that said stem spindle could prevent contact between said stem shoulder and said injector body surface.

* * * * *